US006964410B1

(12) United States Patent
Hansen

(10) Patent No.: US 6,964,410 B1
(45) Date of Patent: Nov. 15, 2005

(54) SUSPENDED GLASS PANEL RAILING SYSTEM

(76) Inventor: Tracy C. Hansen, 5500 SE. Alexander St., Hillsboro, OR (US) 97123

( * ) Notice: Subject to any disclaimer, the term of this patent is extended or adjusted under 35 U.S.C. 154(b) by 35 days.

(21) Appl. No.: 10/292,781

(22) Filed: Nov. 11, 2002

(51) Int. Cl.[7] ..... E04H 17/16
(52) U.S. Cl. ..... 256/24; 256/23; 256/65.02
(58) Field of Search ..... 256/23, 24, 59, 256/65.01, 65.15, 65.014, 65.02; 52/204.7, 52/204.6, 204.64, 204.597, 800.14, 204.591, 52/766, 238.1, 239; 160/135; 198/335–338

(56) References Cited

U.S. PATENT DOCUMENTS 3,869,109 A * 3/1975 Russo ..... 256/59
RE28,643 E * 12/1975 Blum ..... 256/24
4,054,268 A * 10/1977 Sher ..... 256/24
4,067,548 A * 1/1978 Murphy ..... 256/24
4,103,874 A * 8/1978 Horgan, Jr. ..... 256/24
4,155,540 A * 5/1979 Horgan, Jr. ..... 256/23
4,390,165 A * 6/1983 Murdock ..... 256/24
4,690,383 A * 9/1987 Batcheller ..... 256/24
4,841,697 A * 6/1989 Hogg et al. ..... 52/208
4,920,717 A * 5/1990 Hooper, Jr. ..... 256/24
5,200,240 A * 4/1993 Baker ..... 256/59
5,529,288 A * 6/1996 Cheng-I ..... 256/65.16
6,029,954 A * 2/2000 Murdaca ..... 256/59
6,419,209 B1 * 7/2002 Shepherd ..... 256/24
6,517,056 B2 * 2/2003 Shepherd ..... 256/24
2001/0025953 A1 * 10/2001 Shepard

* cited by examiner

*Primary Examiner*—William L. Miller
(74) *Attorney, Agent, or Firm*—Michael J. Tavella

(57) ABSTRACT

An ornamental guardrail system that has an improved base assembly, which allows water and debris to escape from the deck surface. The system uses a mounting arrangement that supports the glass panels above the surface of the deck without using full-height posts. This mounting arrangement makes a structural glass railing useful in many types of construction projects that require the surface water to sheet flow under the railing system, or to achieve a certain visual style.

24 Claims, 15 Drawing Sheets

SUSPENDED GLASS PANEL RAILING SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the invention

This invention relates to a building construction for mounting vertical panels, and relates specifically to a structural glass guardrail system for use on interior and exterior balconies, decks, walkways, landings, and stairways.

2. Description of the Prior Art

Glass panel railing systems that utilize thick, glass panels as the sole vertical support are widely used as guardrails and handrails in the construction of commercial and residential building structures. These systems are typically found on elevated surfaces, acting as functional and aesthetically pleasing guardrails. Moreover, structural glass railing systems are preferred by many over other systems utilizing vertical support posts because they present much less obstruction to the visual field. Additionally, structural glass railing systems have less exposed metal in the system, which serves to lower the amount of maintenance associated with the railing.

The base of such systems are typically found in interior applications and mounted directly to the substrate. One example of such a glass guardrail is disclosed in U.S. Pat. No. Re. 28,643. This patent discloses a glass guardrail in which the panels are secured directly to the floor structure. Because the base is mounted as a continuous run to the substrate, it acts as a dam that blocks the flow of water when it is installed on an exterior deck, balcony, or landing surface. Consequently, prior art systems such as these are mostly utilized in interior applications where drainage is not an issue.

Designs have been developed that elevate the panels above the ground surface. Examples of these can be found in U.S. Pat. Nos. 4,155,540 and 4,690,383. In both of these cases, vertical posts are used to either hold the glass panels directly or to support a top rail that carries the panels. In both cases, the glass panels are positioned above the ground surface. However, in both cases, a full height vertical post is used for support. These posts do form part of the design, but act as visual breaks in the otherwise glass wall. Although these designs do eliminate the damming problem, they do so at the cost of a different visual presentation.

A need therefore exists for a means of suspending the base extrusion above the deck surface, allowing the water and other debris to be evacuated under the railing, and thus creating a system that is applicable to a wide range of exterior applications and that provides a better visual presentation.

BRIEF DESCRIPTION OF THE INVENTION

The instant invention is an improved apparatus for mounting structural glass panel railing for use as guardrails and handrails and the like. The apparatus includes a base assembly with a number of spaced support posts that elevate the base above a mounting surface, without the need for full height posts. The new system provides for the evacuation of water and other debris and creates a unique visual appeal for a structure. Without this elevated base feature, typical structural glass systems would not be applicable for exterior applications where water/debris must flow under the railing system.

This new invention reduces the amount of components and labor associated with a typical post-supported railing. This new invention also solves the drainage problems created by the prior art systems, and allows structural glass railing to be commercially viable for exterior mounting applications.

The glass guardrail system comprises a series of tempered glass infill panels set in a base assembly with an adhesive. A top rail completes the design. Note that because the support posts are not full height, they do not impede the flow of the base show or top rail. Thus, one sees a solid run of rail, base shoe and glass, presenting a pleasing and clean image. Such an image was only possible before by placing the base shoe solidly against the floor surface, which impedes the flow of water as discussed above.

DETAILED DESCRIPTION OF THE INVENTION

Figure 1:
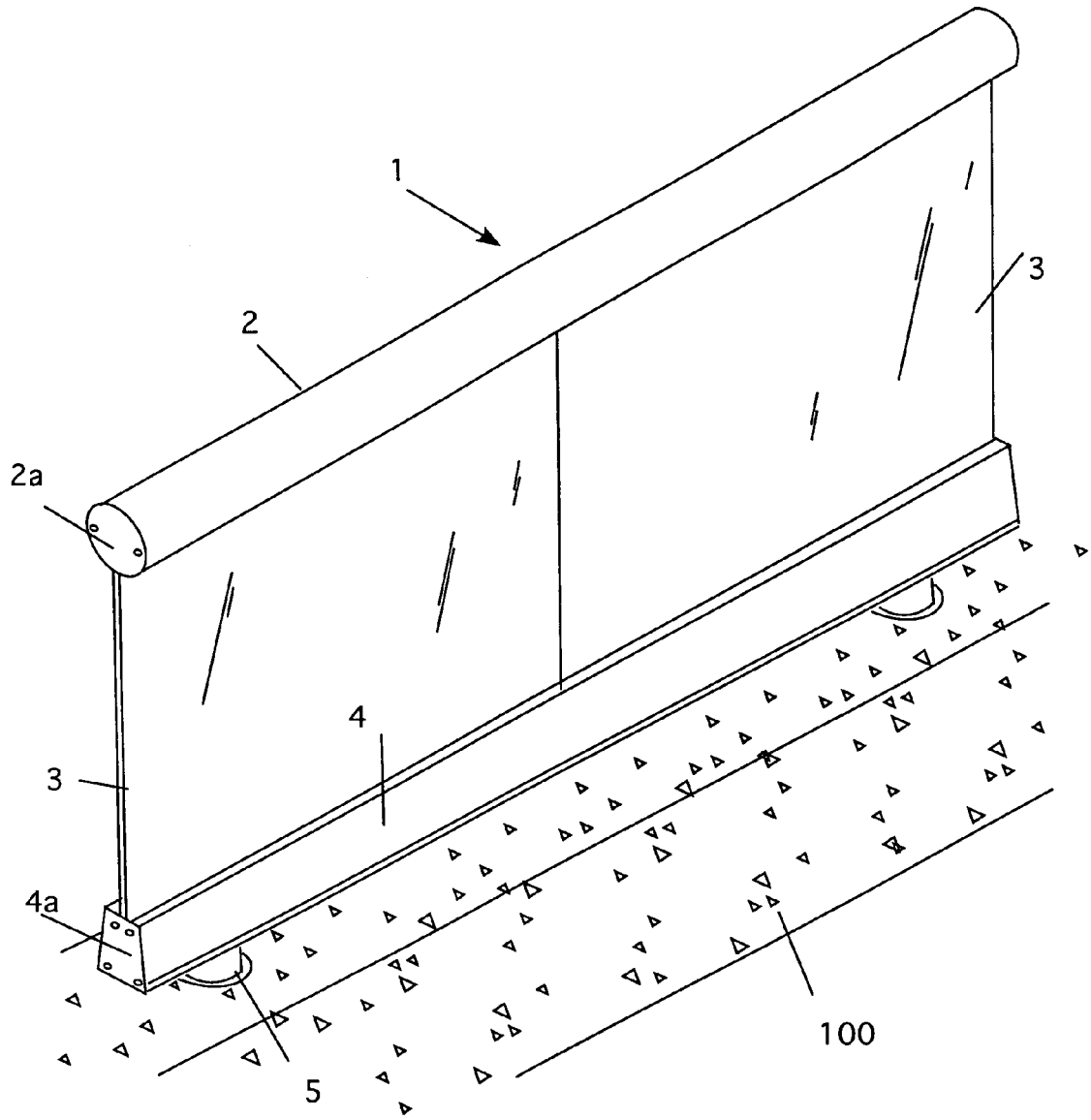
FIG. 1 is a perspective view of a portion of the invention as fully assembled.

Referring now to FIG. 1, my new railing system 1 has a number of sub components. Details of these sub components follow the general description of the system. First, is a top rail 2 is used to secure the tops of glass panels 3. The glass panels are typically ½-inch thick tempered glass. The bottoms of the glass panels fit into an extruded base shoe 4. This view also shows the ends of the rail 2 and shoe 4, which are covered with end caps 2*a* and 4*a* respectively.

Unlike prior art designs, there are no full height posts. Moreover, the base shoe does not rest on the finished floor either. Instead, short support posts 5 are attached to the base shoe, as discussed below. These posts are typically grouted into a concrete slab 100 that forms the base floor of the building in which the system is used. Of course if concrete is not used, the posts are secured using techniques common to that particular art.

Figure 2:
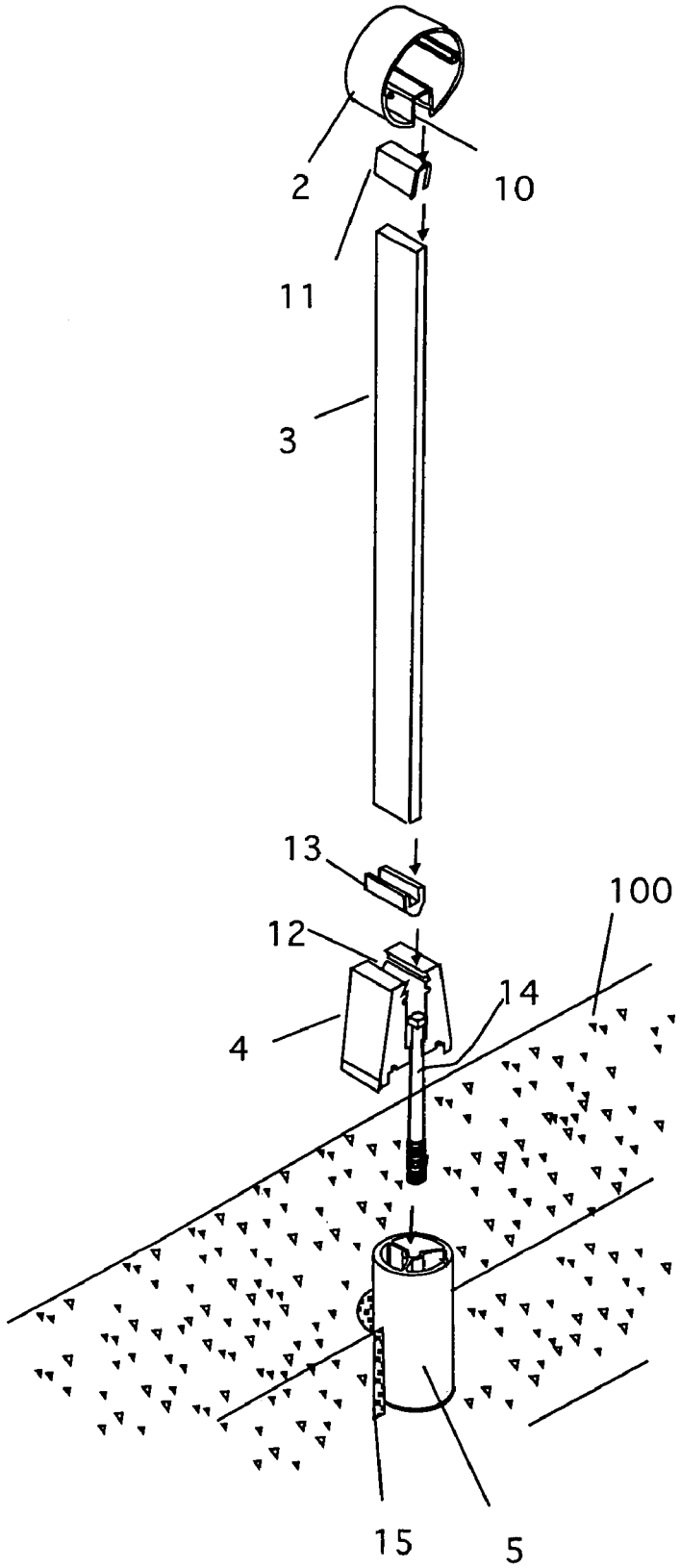
FIG. 2 is a perspective exploded view of a section of the railing system.

FIG. 2 shows a partially exploded view of the system. Here, the components are shown in a little more detail. The top rail 2 has an interior cross-section designed to accommodate splicing of rail (discussed below) and a notch 10 designed to receive a length of rigid PVC 11 (polyvinylchloride) plastic used as a protector for the top of the sheet glass 3. The glass sheet 3 is fitted into a slot 12 in the base shoe 4. Note that a flexible rubber protector 13 is placed in the slot 12 to protect the bottom of the infill panel. A bolt 14 is fitted into the base shoe before the glass and rubber are inserted. The bolt secures the base shoe to the post 5. The posts are spaced at regular intervals to give support for the rail system. Note that in the preferred embodiment, the posts are fixed into the slab 100 using a 10,000 p.s.i. grout 15.

Figure 3:
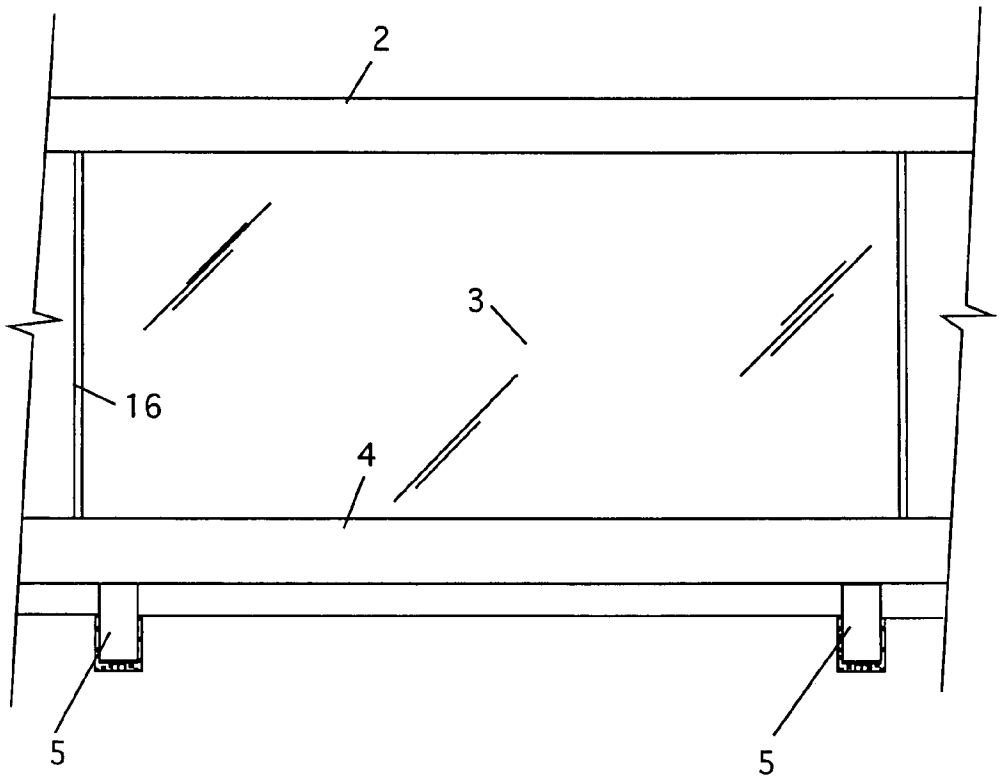
FIG. 3 is a side elevation of the glass railing system as fully assembled.

FIG. 3 shows a side view of a typical length of panel. In the preferred embodiment, the posts 5 are set at an interval determined by project-specific criteria. The posts raise the base shoe above the finished floor level to allow for drainage and to prevent damming of water or other debris within the area bounded by the railing. Note that FIG. 3 shows a typical spacing of a ½ inch gap 16 between the glass panels 3 and that there are no full height posts in the run.

Figure 4:
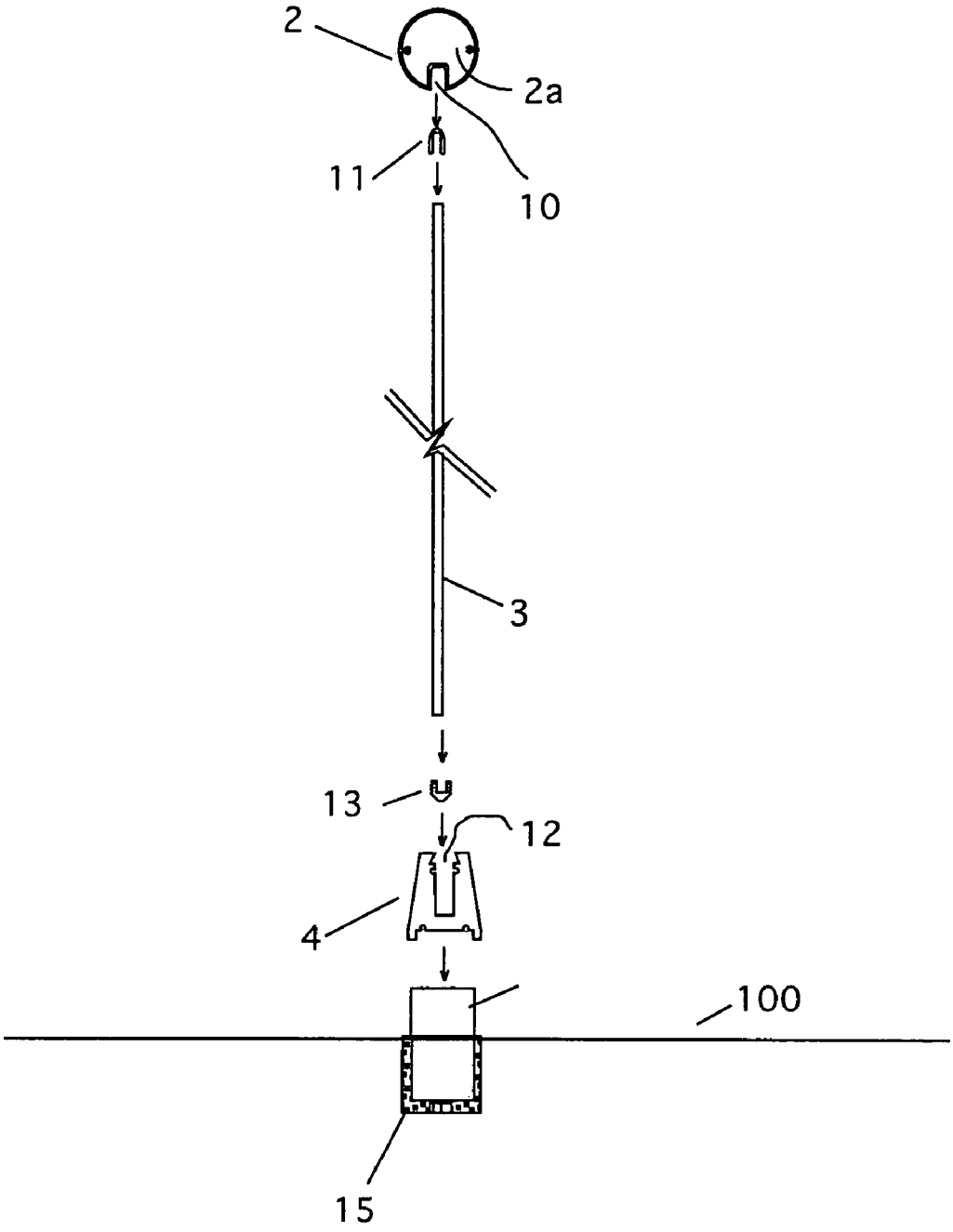
FIG. 4 is a sectional, partially exploded view of the railing system.

FIG. 4 shows an exploded end view of a typical assembly. This view shows the top rail 2 with the end cap 2*a*, the glass panel 3, the base shoe 4, the post 5, the grout 15, the floor surface 100, and the PVC and rubber protectors 11 and 13.

Figure 5:
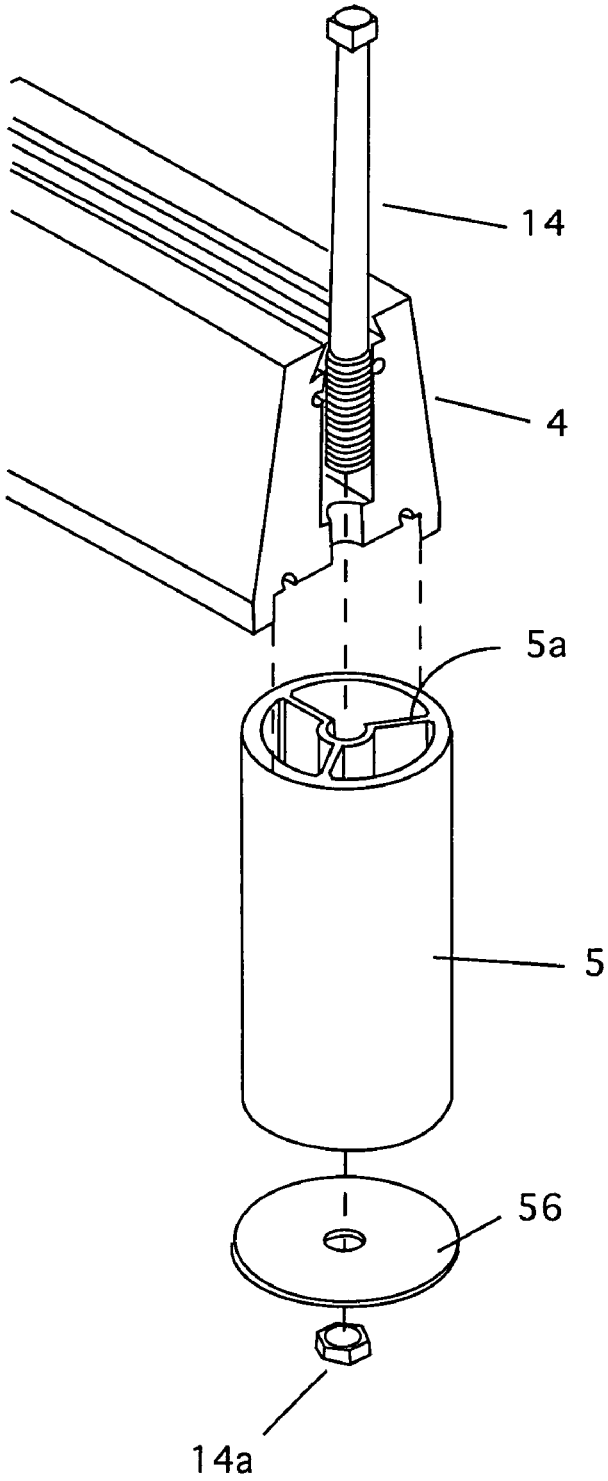
FIG. 5 is an exploded detail of the post and base shoe assembly.

FIG. 5 is an exploded detail of the post and base shoe assembly. In this view details of the post 5 and base shoe 4 are shown. The post 5 is an aluminum extrusion in the preferred embodiment. The post 5 has an internal structure 5*a* that is formed as part of the extrusion. The internal structure gives the post strength as well as providing a channel for the bolt 14 to keep the bolt centered in the post. The post 5 has a base washer 5*b* as shown. Note that this view also shows the securing nut 14*a* that secures the bolt 14 in place.

Figure 6:
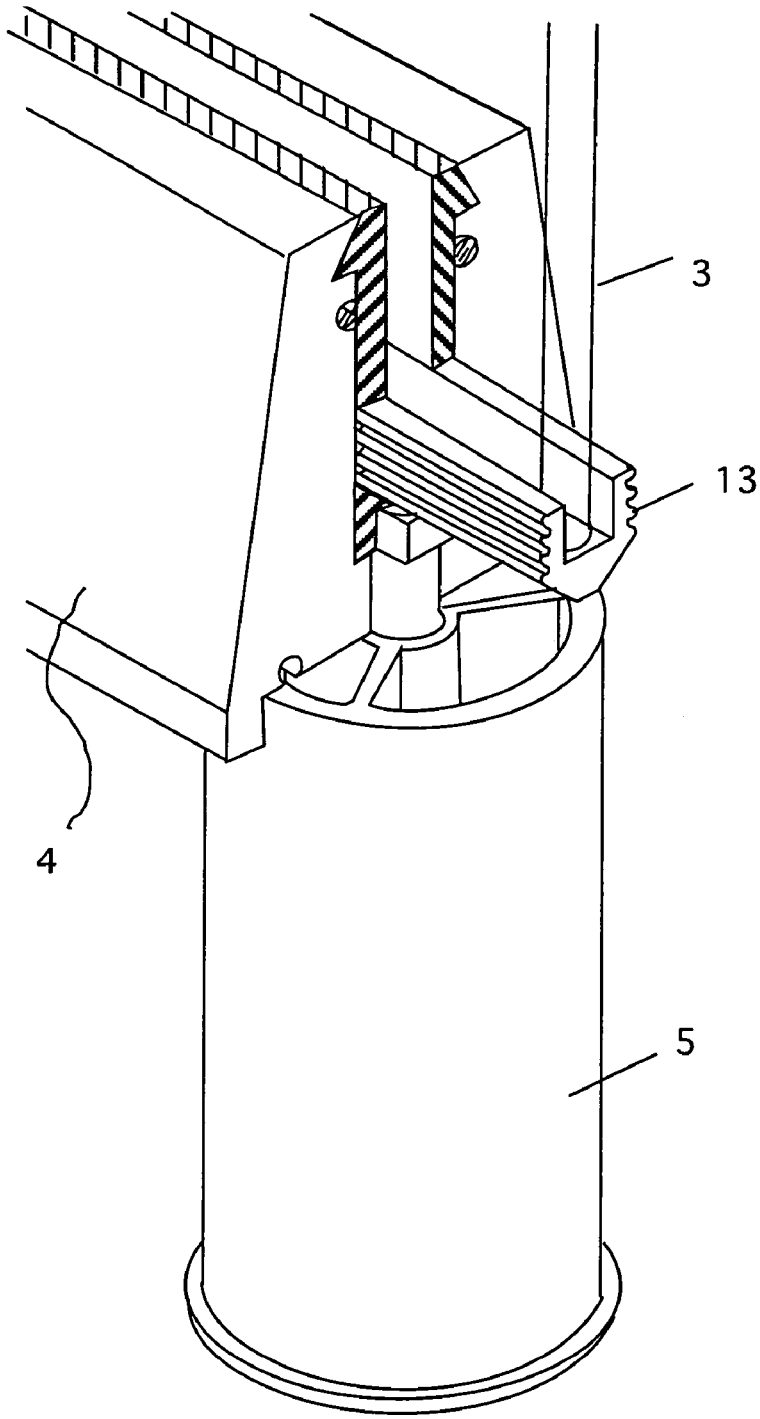
FIG. 6 is an assembled detail of the post and base assembly.

FIG. 6 is a detail view of the assembled post and base shoe assembly. Here, the glass panel 3 is shown in place along with the base protector 13. Note that after the glass is installed in the base shoe 4 it is sealed in place with 10,000 p.s.i. grout or other suitable adhesive. This figure also shows the bolt 14, Note that in the preferred embodiment, this bolt is a ½ inch (12 mm) diameter T-slot stainless steel bolt (available from the McMaster-Carr Company, as part no. 90321A740) or equivalent. The head of the bolt 14 has a tee head that fits into the T slot formed at the bottom of the base shoe. When the nut 14*a* is tightened, the bolt secures the base shoe to the post securely.

Figure 7:
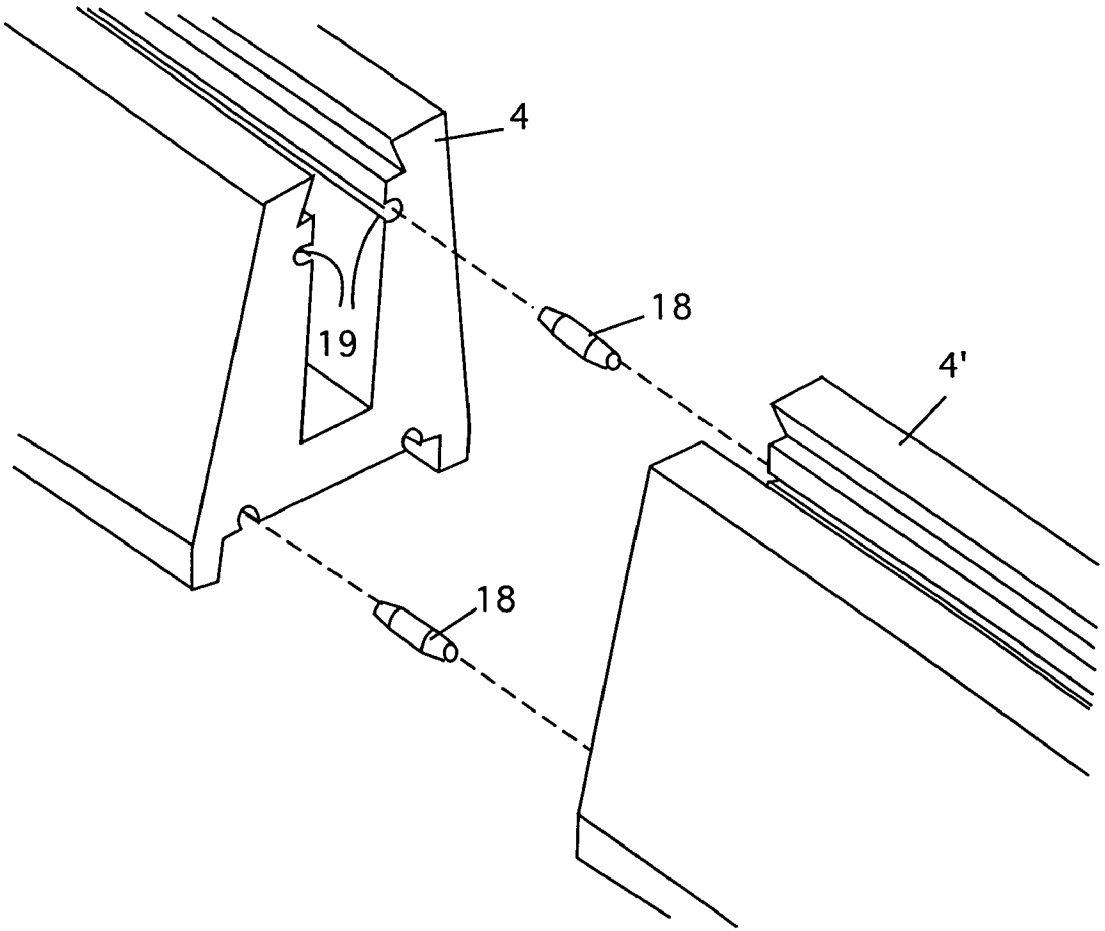
FIG. 7 is a perspective detail view of the splicing system used with the base sections.

FIG. 7 is a perspective detail showing the technique used for splicing straight sections of base shoe. Here, two sections of base shoe 4 and 4' are shown in alignment. Two pins 18 are used for each splice. The pins are secured in the holes 19 formed in the base shoe as shown. In the preferred embodiment, the pins are 316 alloy stainless steel dowel pins 0.250 in (6 mm) diameter by 1 inch (25 mm) long, the pins are secured in one length of base shoe, a second length of base shoe is aligned with the pins and the two lengths are pushed together until the pins are seated and the shoe sections are flush.

Figure 8A:
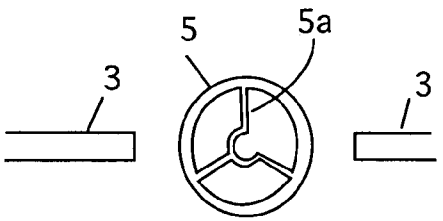
FIG. 8*a* is a top view of the post member.
Figure 8:
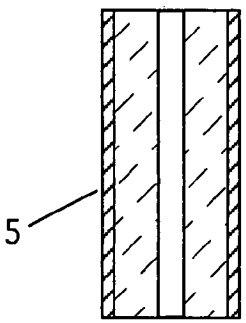
FIG. 8 is a cross-section for the post member.

FIG. 8 is a cross-section of the post. FIG. 8*a* is a top view of the post showing the shape and arrangement of the center extrusion.

Figure 9:
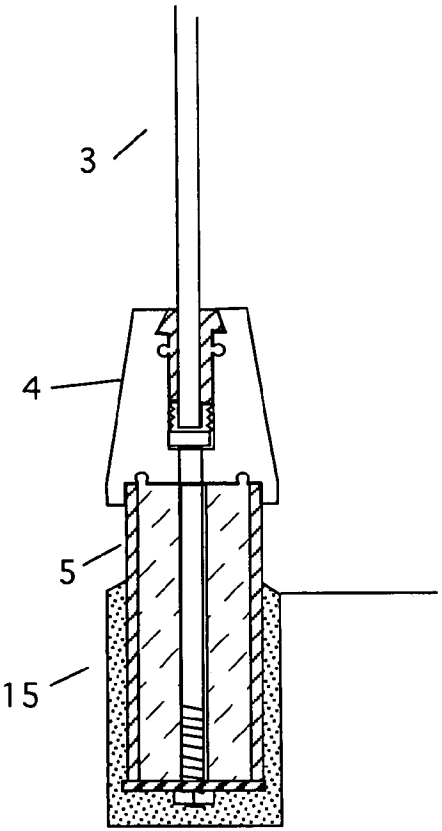
FIG. 9 is a cross-section of the assembled post, base and glass panel.

FIG. 9 shows a cross-section of the base shoe and post assembly as fully assembled and installed in a finish floor. In this view, the glass panel 3 is shown in the base shoe held by grout. Note that the glass panel is typically installed after the posts have been installed on the floor. The bolt is shown in position in the base shoe. The base shoe is shown sitting on top of the post. The bolt is shown passing through the post and the bottom washer, where it is secured by the nut. Note that the washer is oversized to provide a solid grout lock. Once this is done, the entire assembly is placed in the finished floor in a grout bed. Once finished and the grout is cured, the posts and base shoe are immobile. The glass panels can then be added to finish the installation.

Figure 10:
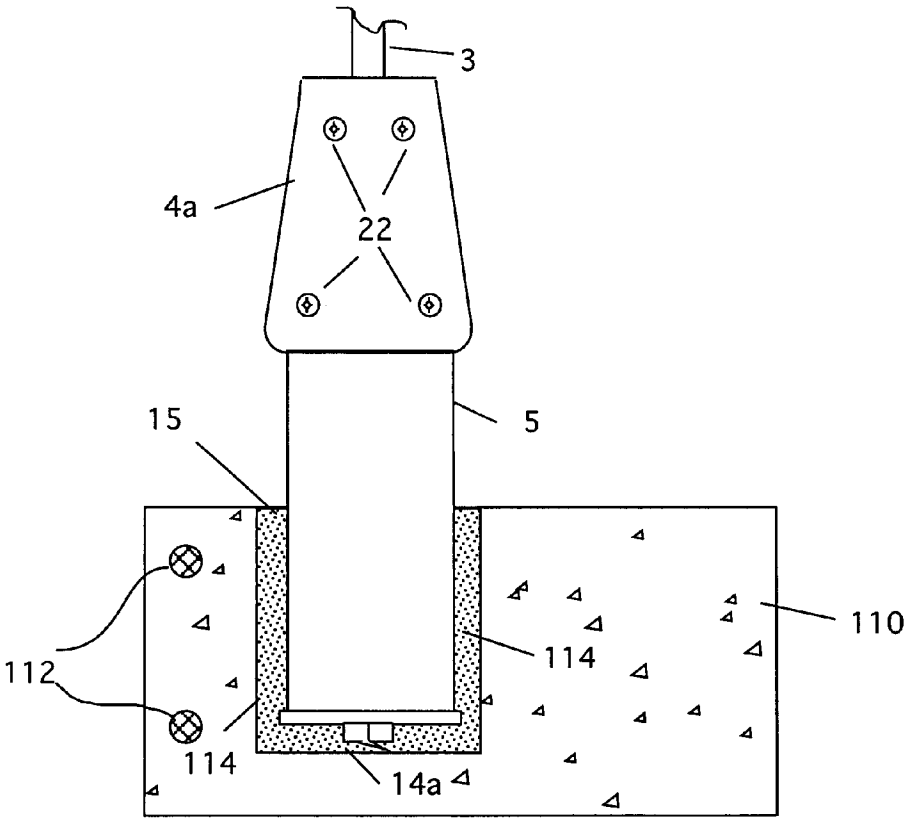
FIG. 10 is an end view of the assembled post and base with an end cap in place.
Figure 12:
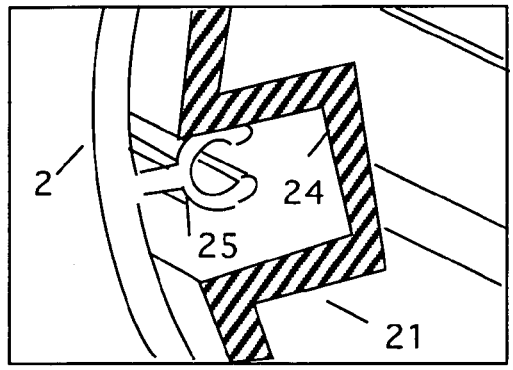
FIG. 12 is a detail view of the railing-to splice groove of the inset 12 of FIG. 11.

FIG. 10 is a view of the base-shoe and post assembly as set in a typical concrete slab. In this application, the slab 110 is formed with reinforcing bars 112 as normal. In the locations designated for posts, a 4-inch (100-mm) diameter, 4-inch (100-mm) deep core pocket 114 is formed in typical applications. This pocket accepts the post 5 as shown. The post is then secured in the pocket 114 by a bed of grout 15 as discussed above. Note also that this figure shows an end cap 4*a* installed on the end of the base shoe. Note that four screws 22 are used to hold the end cap 4*a* in place.

Figure 11:
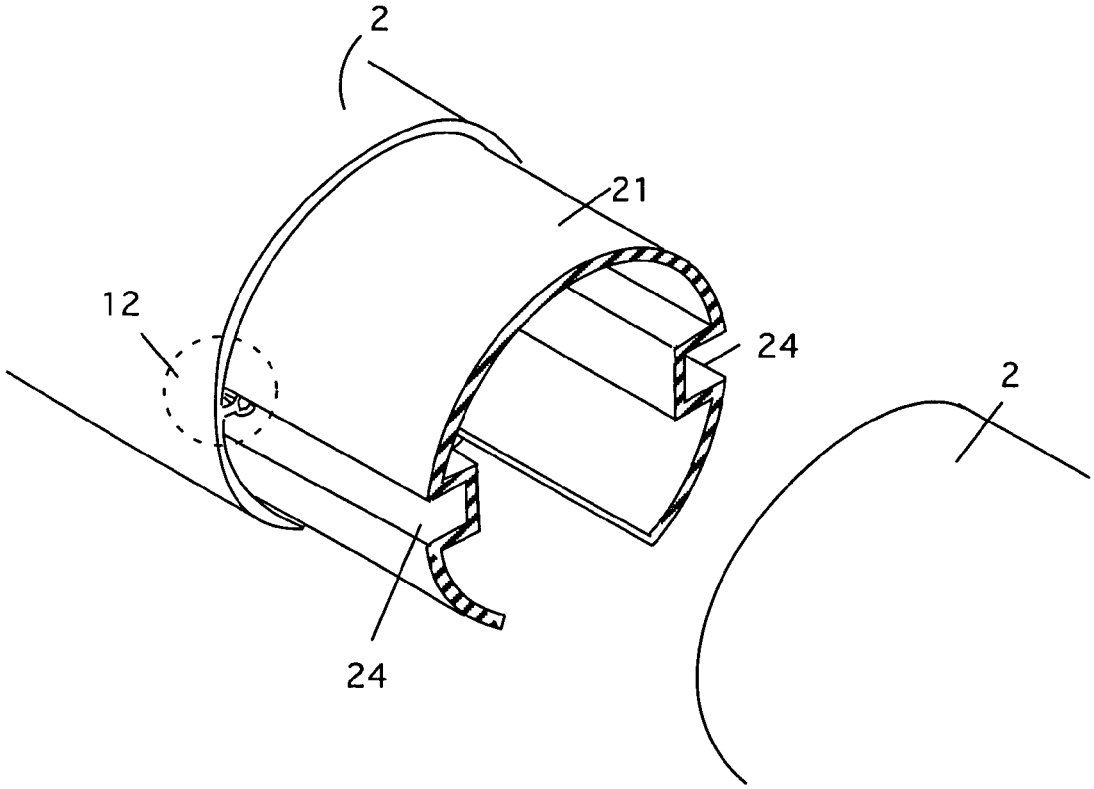
FIG. 11 is a perspective view of the top rail splice.

As shown in FIG. 1, at the top of the glass panels is a cap rail 2. The cap rail is made of extruded aluminum. Details of the rail and splice joints are shown in FIGS. 11–17. FIG. 11 shows the top rail 2 aligned with another section of rail 2'. A splice member 21 is shown inserted into the rail 2. In the preferred embodiment, the splice member 21 is secured into one end of the rail with epoxy. Only one end is secured to allow for thermal expansion. As shown, the splice member 21 has two grooves 24. These grooves are designed to fit around the extrusions 25 that are formed inside the top rail. See also FIG. 12, which is an inset detail of the tubing and the top rail extrusion.

Figure 13:
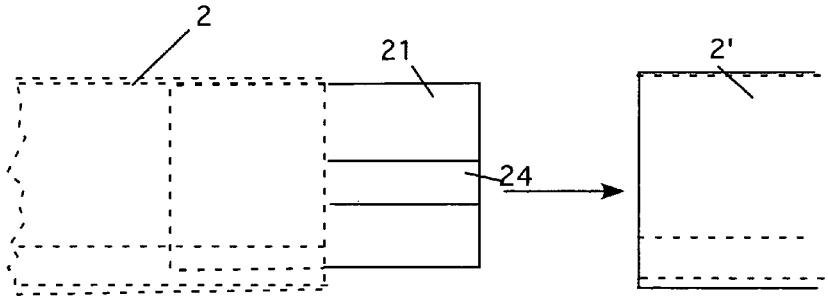
FIG. 13 is a side detail view of the railing splice.
Figure 13A:
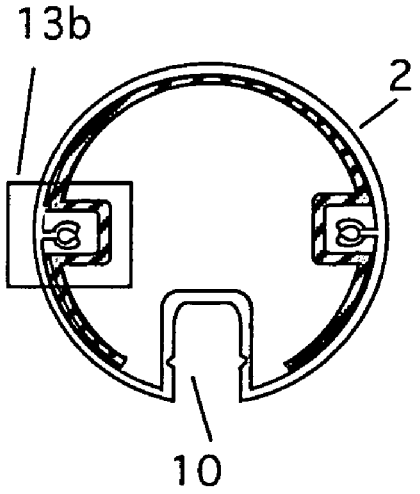
FIG. 13*a* is a front cross-sectional view of the rail and splice as assembled.
Figure 13B:
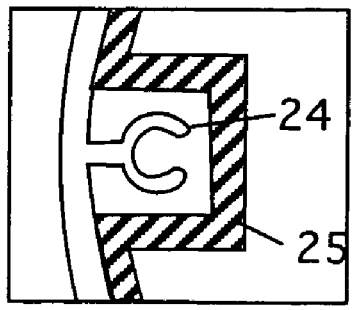
FIG. 13*b* is an inset view of the splice detail of FIG. 13*a*.

FIG. 13 is a side view of the rail 2 and the splice 21 in place showing the splice aligned with a second piece of rail 2'. FIG. 13*a* is a front cross-section showing again how the splice 21 fits around the extrusions 25. FIG. 13*b* is an inset view of the splice and extrusion from a front view.

Figure 14:
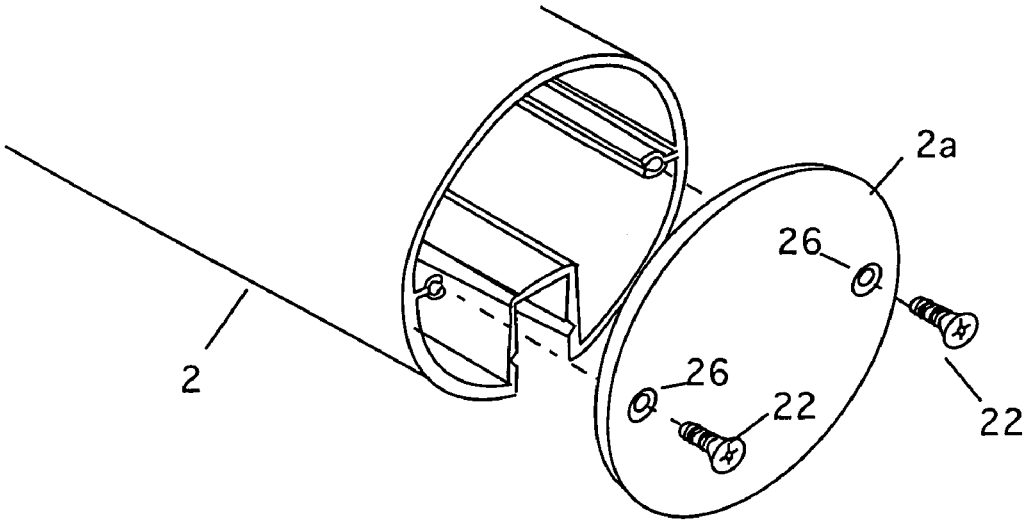
FIG. 14 is a perspective exploded view of the top rail end cap assembly.

FIG. 14 is a detail showing the end cap 2*a* aligned with the rail 2. The end cap 2*a* is held on the rail 2 by screws 22 that pass through holes 26 formed in the end cap. The screws are screwed into the extrusions 25 that are formed in the rail 2 as discussed above.

Figure 15:
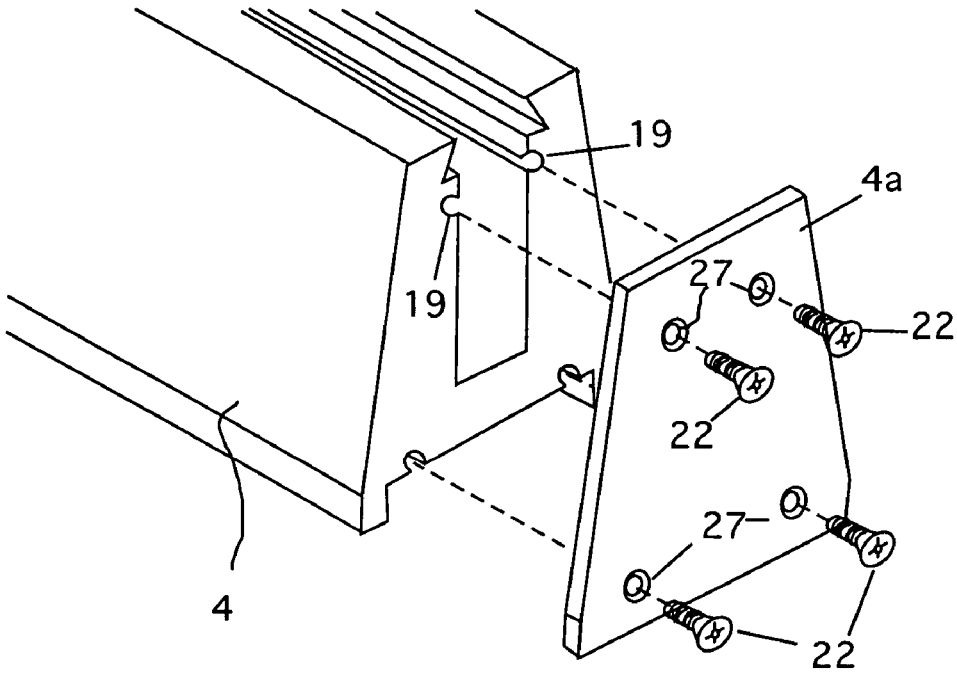
FIG. 15 is a perspective exploded view of the base end cap assembly.

FIG. 15 shows the details of the end cap 4*a* for the base shoe 4 here, four screws 22 pass through holes 27 in the end cap. The screws are screwed into sockets 19 formed in the base shoe, as discussed above.

Figure 16:
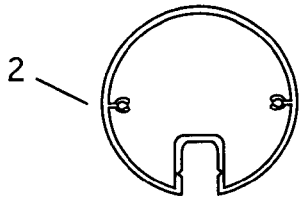
FIG. 16 is a detail end view of the top rail.

FIG. 16 is a detail end view of the top rail 2. This view shows the relative dimensions of the rail.

Figure 17:
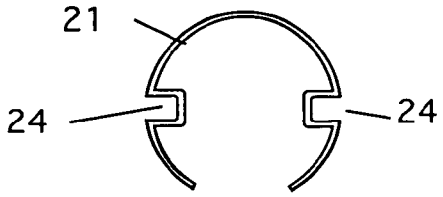
FIG. 17 is an end view of the top rail splice sleeve.

FIG. 17 is an end view of the top rail splice sleeve 21. Again, this view shows the shape of the splice.

Figure 18:
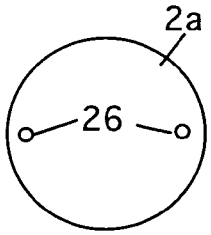
FIG. 18 is a front view of the rail end cap.

FIG. 18 is a front view of the rail end cap 2*a*.

Figure 19:
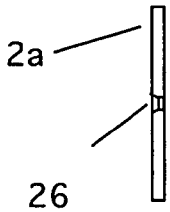
FIG. 19 is a side view of the rail end cap.

FIG. 19 is a side view of the rail end cap 2*a*. This view shows the screw holes 26. Note that the screw holes 26 can be countersunk, depending on the style of hardware used.

Figure 20:
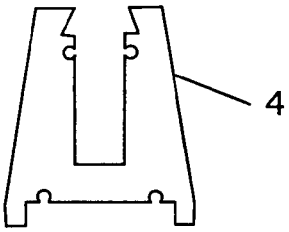
FIG. 20 is a cross-section of the base extrusion.

FIG. 20 is a cross-section of the base extrusion 4. This view clearly shows the dimensional relationships of the structure.

Figure 21:
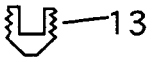
FIG. 21 is a sectional view of a piece of extruded rubber used to protect the glass panels in the base.

FIG. 21 is a cross-sectional view of a piece of extruded rubber 13 used to protect the glass panels in the base.

Figure 22:
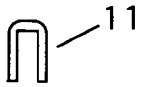
FIG. 22 is a sectional view of a piece of rigid PVC used to protect the glass panels in the rail.

FIG. 22 is a cross-sectional view of a piece of rigid PVC 11 used to protect the glass panels in the rail.

Figure 23:
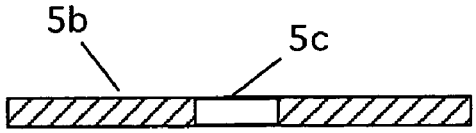
FIG. 23 is a side view of a base plate.

FIG. 23 is a side view of a base washer 5*b*, showing the through hole 5*c* used for the bolt 14.

Figure 24:
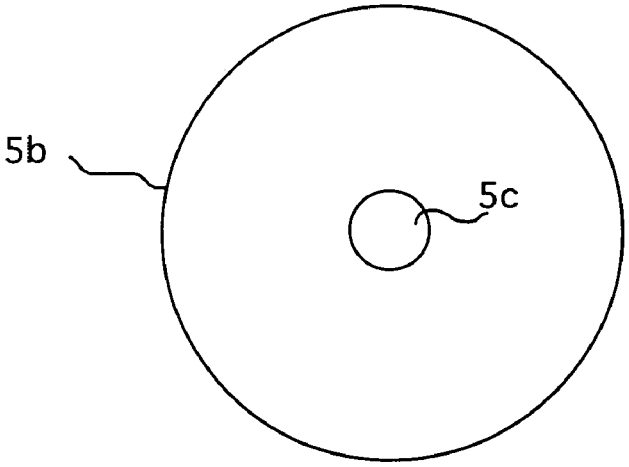
FIG. 24 is a top view of the base plate.

Finally, FIG. 24 is a top view of the base washer 5*b*, showing the through hole 5*c* used for the bolt 14.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A suspended glass panel railing system comprising:

a) a top rail, having a means for holding a glass panel formed therein;

b) a base shoe, having a means for holding a glass panel formed therein;

c) a plurality of glass panels, having a top and a bottom, installed between said top rail and said base shoe; and d) a plurality of base support posts, attached to said base shoe whereby said plurality of base support posts elevates said base shoe above a surface set upright and e) whereby said top rail is supported solely by said plurality of glass panels.

2. The suspended glass panel railing system of claim 1 wherein said top rail comprises a plurality of individual sections and a means for joining said plurality of individual sections into a continuous rail.

3. The suspended glass panel railing system of claim 1 wherein said base shoe comprises a plurality of individual sections and a means for joining said plurality of individual sections into a continuous base shoe.

4. The suspended glass panel railing system of claim 1 further comprising a top pad fitted over said glass panels and inserted into said means for holding in said top rail; and a bottom pad, fitted over said glass panels and inserted into said means for holding in said base shoe.

5. The suspended glass panel railing system of claim 1 wherein said plurality of base support posts is secured to said base shoe by a plurality of bolts.

6. The suspended glass panel railing system of claim 5 wherein said plurality of bolts are secured within said plurality of base support posts with a quantity of high strength grout.

7. The suspended glass panel railing system of claim 1 wherein said plurality of base support posts are partially embedded in a floor surface using a quantity of high strength grout.

8. The suspended glass panel railing system of claim 1 wherein the height of the bottom of said shoe above a floor surface is less than 4 inches (100 mm).

9. A suspended glass panel railing system comprising:

a) a top rail, having a bottom and further wherein said bottom having a slot formed therein;

b) a base shoe, having a bottom and a top and further having an open channel formed therein;

c) a plurality of glass panels, having a top and a bottom, wherein the top of said plurality of glass panels is secured in the slot of said top rail and the bottom of said plurality of glass panels is secured in the channel of said base shoe; and d) a plurality of base support posts, attached to said base shoe whereby said plurality of base support posts elevates said base shoe above a ground surface set upright and e) whereby said top rail is supported solely by said plurality of glass panels.

10. The suspended glass panel railing system of claim 9 wherein said top rail comprises a plurality of individual sections and a means for joining said plurality of individual sections into a continuous rail.

11. The suspended glass panel railing system of claim 9 wherein said base shoe comprises a plurality of individual sections and a means for joining said plurality of individual sections into a continuous base shoe.

12. The suspended glass panel railing system of claim 9 further comprising a top pad fitted over said glass panels and inserted into said slot in said top rail; and a bottom pad, fitted over said glass panels and inserted into said channel said base shoe.

13. The suspended glass panel railing system of claim 9 wherein said plurality of base support posts is secured to said base shoe by a plurality of bolts.

14. The suspended glass panel railing system of claim 13 wherein said plurality of bolts are secured within said plurality of base support posts with a at least one washer and a nut.

15. The suspended glass panel railing system of claim 9 wherein said plurality of base support posts are partially embedded in a floor surface using a quantity of high strength grout.

16. The suspended glass panel railing system of claim 9 wherein the height of bottom of said shoe above a floor surface is less than 4 inches (100 mm).

17. A suspended glass panel railing system comprising:

a) a top rail, having a bottom and further wherein said bottom having a slot formed therein;

b) a base shoe, having a bottom and a top and an open channel formed therein, and further wherein the bottom of said base shoe also having a lower horizontal channel formed thereon;

c) a plurality of glass panels, having a top and a bottom, wherein the top of said plurality of glass panels is secured in the slot of said top rail and the bottom of said plurality of glass panels is secured in the channel of said base shoe; and d) a plurality of base support posts, attached to said base shoe in said lower channel, whereby said plurality of base support posts elevate said base shoe above a ground surface set upright and e) whereby said top rail is supported solely by said plurality of glass panels.

18. The suspended glass panel railing system of claim 17 wherein said top rail comprises a plurality of individual sections and a means for joining said plurality of individual sections into a continuous rail.

19. The suspended glass panel railing system of claim 17 wherein said base shoe comprises a plurality of individual sections and a means for joining said plurality of individual sections into a continuous base shoe.

20. The suspended glass panel railing system of claim 17 wherein further comprising a top pad fitted over said glass panels and inserted into said slot in said top rail; and a bottom pad, fitted over said glass panels and inserted into said channel said base shoe.

21. The suspended glass panel railing system of claim 17 wherein said plurality of base support posts is secured to said base shoe by a plurality of bolts.

22. The suspended glass panel railing system of claim 21 wherein said plurality of bolts are secured within said plurality of base support posts with a abase washer and a nut.

23. The suspended glass panel railing system of claim 17 wherein said plurality of base support posts are partially embedded in a floor surface using a quantity of high strength grout.

24. The suspended glass panel railing system of claim 17 wherein the height of bottom of said shoe above a floor surface is about 4 inches (100 mm).

* * * * *